US006599224B2

(12) United States Patent
Magnani

(10) Patent No.: US 6,599,224 B2
(45) Date of Patent: Jul. 29, 2003

(54) BRAKING ROLLER FOR SYSTEMS FOR CUTTING METAL BANDS INTO STRIPS

(75) Inventor: Giulio Magnani, Lecco (IT)

(73) Assignee: Fimi Fabbrica Impianti Macchine Industriali S.p.A., Lecco (IT)

( * ) Notice: Subject to any disclaimer, the term of this patent is extended or adjusted under 35 U.S.C. 154(b) by 0 days.

(21) Appl. No.: 09/864,933

(22) Filed: May 24, 2001

(65) Prior Publication Data

US 2002/0006854 A1 Jan. 17, 2002

(30) Foreign Application Priority Data

May 31, 2000 (IT) ..... MI00A001208

(51) Int. Cl.[7] ..... B25F 5/02; B21D 53/00

(52) U.S. Cl. ..... 492/47; 492/40; 29/895.22

(58) Field of Search ..... 492/4, 39, 38, 492/40, 47; 226/195, 419.9; 100/163 R; 29/895.22, 895.2

(56) References Cited

U.S. PATENT DOCUMENTS 3,547,332 A 12/1970 Gaudin
3,666,195 A * 5/1972 Gaudin ..... 226/190
3,685,711 A * 8/1972 Gay ..... 226/191
4,026,491 A 5/1977 Bostroem
4,120,576 A * 10/1978 Babish ..... 492/47
4,347,962 A 9/1982 Uphues
5,454,502 A 10/1995 Hashikawa
6,440,048 B1 * 8/2002 Bleil et al. ..... 492/46

FOREIGN PATENT DOCUMENTS

GB 1 342 907 1/1974

* cited by examiner

*Primary Examiner*—Gregory Vidovich
*Assistant Examiner*—Marc Jimenez
(74) *Attorney, Agent, or Firm*—Hedman & Costigan, P.C.

(57) ABSTRACT

Braking roller for systems for cutting metal bands into strips, characterized in that it comprises a rotating and motorized (21) shaft (20), with two supported (in 33) end pins (22, 23), which in a central side surface (24) carries a series of idle pulleys (25), axially held (in 27), in said central side surface (24) there being provided at least one recess (30) inside which there is arranged at least one inflatable element (29) above which there is arranged at least one wear element (34) that is made to abut inwards of each idle pulley (25). The roller can be used both into a tow group and as braking bridle or as baffle roller according to the specific need.

8 Claims, 3 Drawing Sheets

BRAKING ROLLER FOR SYSTEMS FOR CUTTING METAL BANDS INTO STRIPS

BACKGROUND OF THE INVENTION

The present invention relates to a braking roller for systems for cutting metal bands into strips.

There are known systems that carry out the longitudinal cutting of metal bands into a series of longitudinal strips that are afterward used for various transformations.

In these systems for the longitudinal cutting of metal bands into strips, which are more commonly known as "slitters", it is essential that once cut, the strips obtained from the band correctly wind so as to prevent difficulties of both rewinding and of successive treatment.

For this purpose, a braking system of the same strips is provided before their winding into single rolls.

The braking system that is part of the system itself must guarantee a correct and even winding tension of the single strips. In fact, it must be possible to compensate the difference of speed that generates after possible differences of thickness between a strip and the other, since the transversal section of the initial band may not have an even thickness. In fact, it may be thinner at the longitudinal side edges with central swelling, or it may be thinner centrally starting from the thicker longitudinal edges.

Moreover, these differences of speed and optional braking systems must not damage the surface of the band being machined, that must be protected as much as possible.

For example, felt elements used as braking system are known, guided into containment housings, that are determined in engagement on the strips of the passing band through an underlying inflatable thrust element. Since such elements transversally arranged with respect to the band, or to the single strips, are standstill with respect to the band, they cause a rapid wear and in any case, they do not guarantee the respect of the band surface.

As an alternative, the rubber surface of braking rollers—called "presser rollers"—acting on the band strips, has also been provided with a series of surface peripheral notches, transversal to the roller axis, thus creating a series of rubber teeth that may allow some possibilities of bending in the advancement direction of the strip, or in the opposite direction. Such "folding" or "yielding" surface tooth should facilitate the adaptation to the speed of the single strip of the braking roller. In this way, there would be a suitable differentiated braking on the associated strips cut from the band.

Also this solution exhibits some limitations due to the minimum quantity of deformation that is possible to obtain due to the operation noise and to the regulation difficulties.

SUMMARY OF THE INVENTION

Purpose of the present invention is therefore that of realising a braking roller, called "presser roller", for systems for cutting metal bands into strips, which should solve the above technical problems.

Another purpose is that of eliminating any possible difficulty of braking even in the presence of strong variations between the speeds of the different strips obtained from the cutting.

Another purpose is that of eliminating any possible defect that may arise on the surface of the strips due to the braking, so as to protect the surfaces of the same strips.

Another purpose is that of realising a braking roller for systems for cutting metal bands into strips that should be little expensive and easy to manufacture and operate, without problems of continuous adjustment or setting interventions.

These purposes according to the present invention are obtained by realizing a braking roller for systems for cutting metal bands into strips, comprising a rotating and motorized (21) shaft (20), with two support bearings (33) adapted to support end pins (22, 23), which are located within a central side surface (24), which carries a series of idle pulleys (25), axially held by two side containment flanges (27), wherein said central side surface (24) there is provided at least one recess (30) inside which there is arranged at least one inflatable element (29) above which there is arranged at least one wear element (34) that is made to abut inwards of each idle pulley (25).

Additional features are illustrated in the dependent claims.

BRIEF DESCRIPTION OF THE DRAWINGS

The features and advantages of a braking roller for systems for cutting metal bands into strips according to the present invention will appear more clearly from the following exemplificative and non-limiting description, made with reference to the attached schematic drawings. In such drawings.

DETAILED DESCRIPTION OF THE INVENTION

Figure 1:
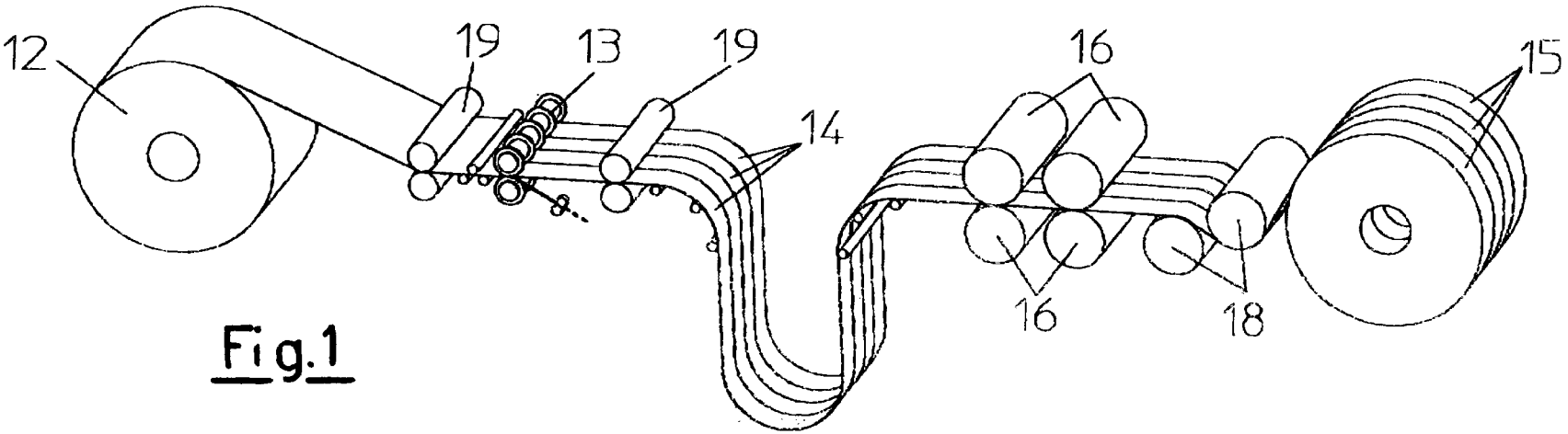
FIG. 1 shows a perspective view of a first embodiment of a system for cutting a metal band into a series of strips wherein at least one braking roller according to the present invention is used.
Figure 2:
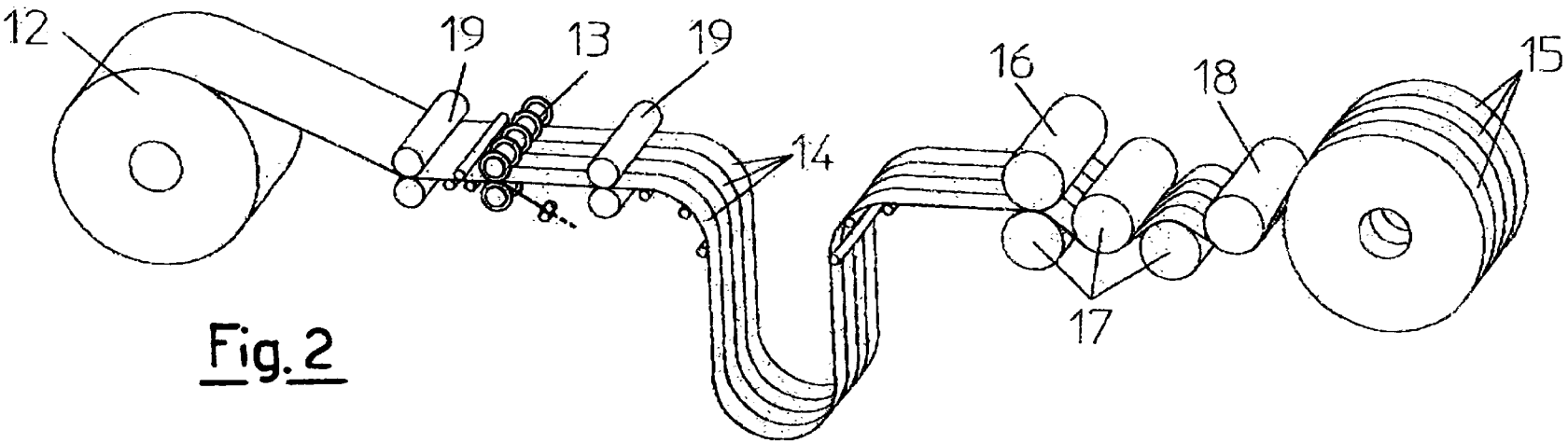
FIG. 2 shows a perspective view of a second embodiment of a system for cutting a metal band into a series of strips wherein at least one braking roller according to the present invention is used.

With reference to FIGS. 1 and 2, there are shown two systems for cutting metal bands into strips, where braking rollers or "presser rollers" can be arranged according to different solutions.

FIG. 1 shows a system wherein a roll of band 12, once cut through a special shear 13, generates a certain number of strips 14, which must then be wound into final rolls 15 through a special winding reel. Braking rollers, as well as a compensation area, are provided between shear 13 and the winding reel so as to facilitate such operation.

FIG. 1 shows how it is possible to provide, in the braking units, drafting elements consisting of one or two "braking rollers", or braking rollers 16 according to the invention, in collaboration with baffle rollers 18 and simple tows 19. FIG. 2 shows how braking rollers according to the invention can be used as baffle rollers 18 or as braking bridles 17, thus solving the problems of known braking rollers of the prior art.

Figure 3:
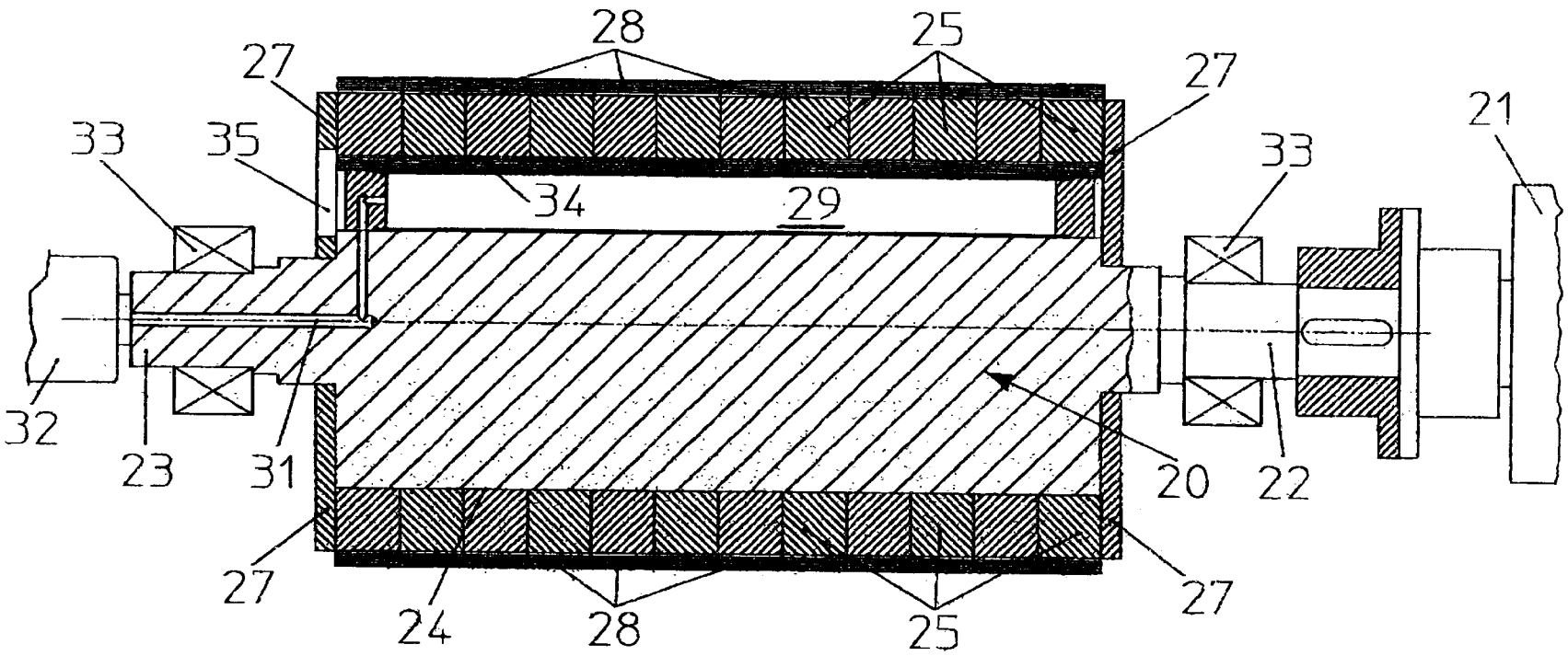
FIG. 3 shows a front partly sectioned view of a braking roller according to the present invention.
Figure 4:
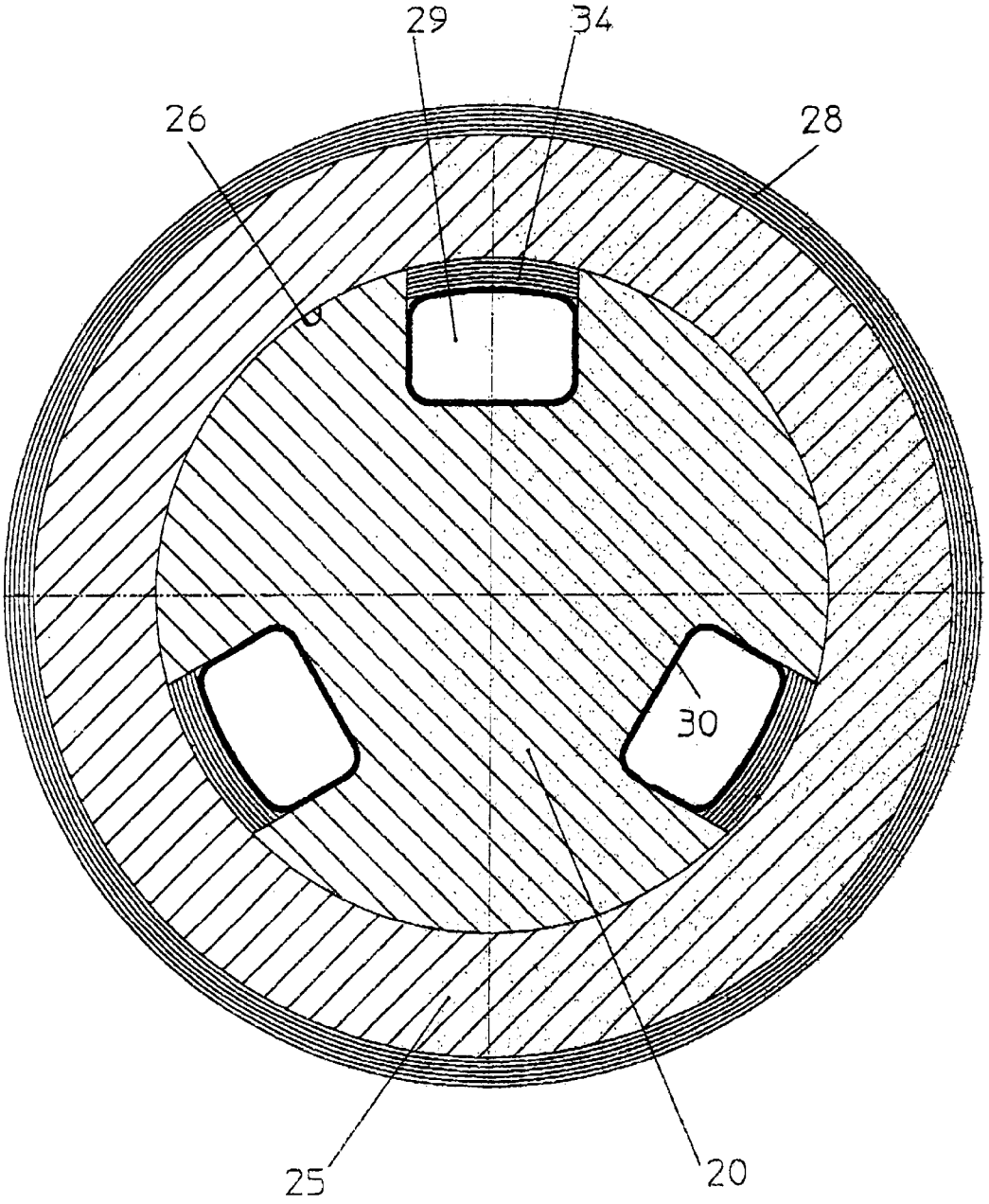
FIG. 4 shows an enlarged transversal section of the braking roller of FIG. 3.

FIGS. 3 and 4 respectively show a front partly sectioned view of a braking roller and an enlarged transversal section of the same braking roller that in general can be used for systems for cutting metal bands into strips.

A braking roller 16, 17, 18 according to the present invention has been devised as braking element for "slitter"

systems in general; that is to say that it can be used as component of one or more tangential braking tows, as component of one or more braking bridles, or simply as baffle roller, in the schematic system shown in FIGS. 1 and 2.

As it can be seen in the figures, a braking roller 16, 17, 18 consists of a series of elements combined in a particular manner.

In fact, a shaft 20 is provided, towed into rotation by a motor, schematised in 21, which is thus rotating, that forms the carrying structure. Shaft 20 is provided with two end pins 22 and 23 adapted to receive support bearings, schematised in 33, of the same roller and on one side, it connects to the above motorisation unit.

In general, on a central side surface 24 there is arranged a series of idle pulleys 25, centrally drilled in 26, arranged on the side surface 24 of shaft 20 and axially held by two side containment flanges 27. In this way, the idle pulleys 25 can freely rotate without any axial movement, and they can be externally provided with a covering in 28, made of a scratch-proof engagement material of various types, such as for example rubber material, leather, spunbonded fabric, etc.

Moreover, according to the invention, there are provided one or n inflatable elements 29, inserted into special recesses 30 obtained on the central side surface 24 of the shaft according to longitudinal generating lines. The inflatable elements 29, such as air tubes or the like, are fed from the outside with pressurised air through a pipe 31 connected to a rotating joint, schematised in 32, fastened to the other end of shaft 20. The pressure into the inflatable elements 29 can be regulated in function of the particular requirements from the outside, in a quick and simple manner, even during the operation of the braking roller into the system.

Moreover, according to the invention, one or n wear elements 34 are provided, one for each inflatable element 29, arranged into recesses 30 and such as to fill them with the inflatable element 29, so as to try to protrude inwards of each idle pulley 25. In fact, the wear element 34 is made by the inflatable element 29 to abut against the inside surface of each idle pulley 25. These wear elements 34 can be made of various types of material, for example felt, brake lining, etc., and they can be easily replaced by side extraction through suitable slits 35 obtained on the side containment flanges 27. In case of bad operation, it is even possible to replace the inflatable elements 29.

The operating principle of the braking roller 16, 17, 18 of the present invention is as follows: the roller is put into rotation by motor 21 connected to shaft 20 so that the peripheral speed corresponding to the outside surface of pulleys 25, or of covering 28, is slightly less than the speed of strip 14 of band 12, which is slower.

In this way, each pulley 25, pulled by strip 14 into contact with it, rotates—with respect to shaft 20—at a slightly higher speed than the difference between its speed and the speed of the slower strip.

By suitable adjusting the feeding air pressure of the inflatable elements 29, through the wear elements 34, a resisting force is generated that opposes the rotation of the single pulleys 25 with respect to shaft 20, thus creating the braking effect of strips 14 being wound on the final rolls 15.

Since pulleys 25 are totally disengaged from one another, the difference of speed of strips 14 is totally compensated, with a winding tension that is perfectly even and distributed on the entire width.

The problems of known braking systems are thus solved in a simple, practical and inexpensive manner.

The presence of the pulleys, of the covering of the same, if present, and of the inflatable element and of the wear element allows the adjustment to the different speeds of the strips of the single portion of the braking roller in a functional, correct and practical manner. In fact, it is possible to guarantee a correct and even winding tension of the single strips, thus compensating the difference of speed that generates after possible differences of thickness between the strips. The presence of the pulleys, of the inflatable element and of the wear element, as well as of the pulley covering, allows a suitable adjustment.

In fact, it is possible to have a good adjustment also in case of strong differences between the various strips.

Moreover, there are no possibilities of scoring or defects on the strip surface since there is no difference of speed, and thus of entrainment, between the roller pulleys and the strips. Thanks to the rotation of the roller, which is motorised in 21, the speed difference between pulleys 25 and shaft 20 is minimum, to the advantage of the wear element 34.

Several modifications and variants can be made to the braking roller for systems for cutting metal bands into strips thus conceived, all falling within the invention; moreover, all details can be replaced with other technically equivalent details. In practice, the materials used as well as the sizes, can be of any type.

What is claimed is:

1. A braking roller for systems for cutting metal bands into strips, comprising a rotating and motorized (21) shaft (20), with two support bearings (33) adapted to support end pins (22, 23), which are located within a central side surface (24), which carries a series of idle pulleys (25), axially held by two side containment flanges (27), wherein said central side surface (24) there is provided at least one recess (30) inside which there is arranged at least one inflatable element (29) above which there is arranged at least one wear element (34) that is made to abut inwards of each idle pulley (25), said series of idle pulleys (25) is axially held by two side containment flanges (27) that allow their relative rotation; wherein at least one of said two side containment flanges (27) exhibits at least one slit (35) for the extraction and/or insertion of said at least one wear element (29) and at least one of said two side containment flanges (27) exhibits at least one slit (35) for the extraction and/or insertion of said at least one inflatable element (29).

2. A braking roller according to claim 1, wherein said at least one inflatable element (29) is fed from the outside with pressurized air through a pipe (31) connected to a rotating joint (32) fastened to an end pin (23) of said shaft (20).

3. A braking roller according to claim 1, wherein each of said series of idle pulleys (25) is provided with a covering (28) made of a scratch-proof engagement material.

4. A braking roller according to claim 3, wherein said scratch-proof engagement material comprises rubber material, leather or spunbonded fabric.

5. A braking roller according to claim 1, wherein said shaft (20) is provided with a motor (21) connected to one (21) of two end pins (22, 23).

6. A braking roller according to claim 1, wherein said at least one wear element (34) consists of felt or brake lining.

7. A braking roller according to claim 1, wherein said at least one inflatable element (29) consists of at least one air tube.

8. A braking roller according to claim 1, which can be used as a braking tow (16) and/or as a baffle roller (18) or as a braking bridle (17).

* * * * *